US009809343B2

(12) United States Patent
Bowers et al.

(10) Patent No.: US 9,809,343 B2
(45) Date of Patent: Nov. 7, 2017

(54) DEVICES, SYSTEMS, AND METHODS FOR AUTOMATICALLY PRINTING AND APPLYING LABELS TO PRODUCTS

(71) Applicant: BELL AND HOWELL, LLC, Durham, NC (US)

(72) Inventors: Brian Bowers, Mundelein, IL (US); Tim Palmer, Lexington, NC (US)

(73) Assignee: Fluence Automation LLC, Wheeling, IL (US)

( * ) Notice: Subject to any disclaimer, the term of this patent is extended or adjusted under 35 U.S.C. 154(b) by 0 days.

(21) Appl. No.: 14/886,549

(22) Filed: Oct. 19, 2015

(65) Prior Publication Data

US 2016/0052659 A1 Feb. 25, 2016

Related U.S. Application Data

(63) Continuation-in-part of application No. 14/043,259, filed on Oct. 1, 2013, now Pat. No. 9,352,872.
(Continued)

(51) Int. Cl.
*B65C 9/02* (2006.01)
*B65C 9/40* (2006.01)
(Continued)

(52) U.S. Cl.
CPC ..... *B65C 9/02* (2013.01); *B65C 1/021* (2013.01); *B65C 9/1826* (2013.01);
(Continued)

(58) Field of Classification Search
CPC ..... B65C 1/021; B65C 9/02; B65C 9/1826; B65C 9/1884; B65C 9/40;
(Continued)

(56) References Cited

U.S. PATENT DOCUMENTS 5,232,539 A 8/1993 Carpenter et al.
5,342,461 A 8/1994 Murphy
(Continued)

FOREIGN PATENT DOCUMENTS

EP 2716560 7/2015
EP 3 012 203 A1 4/2016
(Continued)

OTHER PUBLICATIONS

Restriction Requirement for U.S. Appl. No. 14/043,259 dated Jul. 8, 2015.
(Continued)

*Primary Examiner* — George Koch
(74) *Attorney, Agent, or Firm* — Jenkins, Wilson, Taylor & Hunt, P.A.

(57) ABSTRACT

Devices, systems, and methods for automatically printing and applying one or more label to at least one item to enable shipping of the at least one item by a carrier are provided. In some aspects, a movable label applicator device includes a printer for printing the one or more label onto a supply of labeling material, wherein the one or more printed label contains unique information associated with the at least one item. In some aspects, the device further includes an applicator for applying the one or more printed label to a surface of the at least one item, wherein the applicator is configured to apply multiple labels to the surface of the at least one item such that the multiple labels are removably stacked on top of one another.

20 Claims, 12 Drawing Sheets

Related U.S. Application Data

(60) Provisional application No. 62/066,268, filed on Oct. 20, 2014, provisional application No. 61/709,403, filed on Oct. 4, 2012.

(51) Int. Cl.
*B65C 1/02* (2006.01)
*B65C 9/18* (2006.01)
*B65C 9/00* (2006.01)

(52) U.S. Cl.
CPC ..... *B65C 9/1884* (2013.01); *B65C 9/40* (2013.01); *B65C 2009/0081* (2013.01); *B65C 2009/401* (2013.01); *Y10T 156/1062* (2015.01)

(58) Field of Classification Search
CPC ..... B65C 2009/0081; B65C 2009/401; G07B 17/00508; G07B 2017/00596; G07B 2017/0062; Y10T 156/1062
USPC ... 156/64, 351, 360, 362, 367, 378, DIG. 45
See application file for complete search history.

(56) References Cited

U.S. PATENT DOCUMENTS

| | | | | |
|---|---|---|---|---|
| 5,705,021 | A * | 1/1998 | Wurz | B65C 1/021 156/360 |
| 5,750,004 | A | 5/1998 | Wurz et al. | |
| 5,783,032 | A | 7/1998 | O'Callaghan et al. | |
| 5,922,169 | A | 7/1999 | Chodacki et al. | |
| 6,080,250 | A | 6/2000 | Urban | |
| 6,273,986 | B1 | 8/2001 | Egan | |
| 6,616,189 | B2 | 9/2003 | Raming | |
| 7,121,311 | B2 | 10/2006 | Vandersyde et al. | |
| 7,185,689 | B2 | 3/2007 | Jenkins et al. | |
| 7,437,860 | B2 | 10/2008 | Brandow et al. | |
| 7,632,367 | B2 | 12/2009 | Smith | |
| 7,900,675 | B2 | 3/2011 | Dangami | |
| 7,987,141 | B2 | 7/2011 | Lee | |
| 9,352,872 | B2 | 5/2016 | Wojdyla et al. | |
| 2002/0193225 | A1* | 12/2002 | Raming | B42D 15/006 493/375 |
| 2004/0112520 | A1 | 6/2004 | Hanschen et al. | |
| 2005/0139323 | A1 | 6/2005 | Syde et al. | |
| 2006/0201348 | A1* | 9/2006 | Lee | B65C 1/02 101/11 |
| 2007/0102109 | A1 | 5/2007 | Katritzky et al. | |
| 2014/0096900 | A1 | 4/2014 | Wojdyla et al. | |
| 2016/0251103 | A1 | 9/2016 | Wojdyla et al. | |

FOREIGN PATENT DOCUMENTS

| | | | |
|---|---|---|---|
| FR | 2719283 | A1 | 11/1995 |
| GB | 2076549 | A | 12/1981 |
| JP | 2012071849 | A | 4/2012 |
| WO | WO 9308081 | A1 | 4/1993 |
| WO | WO 9323292 | A1 | 11/1993 |

OTHER PUBLICATIONS

Notice of Allowance for U.S. Appl. No. 14/043,259, dated Mar. 29, 2016.
European Search Report issued in European Patent Application No. 15190609.6, dated Mar. 18, 2016.
Notice of Publication for U.S. Appl. No. 15/190,609 dated Mar. 31, 2016.
Non-Final Office Action for U.S. Appl. No. 15/144,318 dated Sep. 12, 2016.
Notice of Publication for U.S. Appl. No. 15/144,318 dated Sep. 2, 2016.
European Search Report issued in European Patent Application No. 13 18 7282, dated Jan. 30, 2014.
SATO America at a Glance, from https://www.satoamerica.com/about-sato/sato-america-at-a-glance.aspx, site accessed on Sep. 29, 2015.
Non-Final Office Action for U.S. Appl. No. 14/043,259, dated Oct. 9, 2015.
Final Office Action for U.S. Appl. No. 15/144,318 dated Mar. 15, 2017.

* cited by examiner

DEVICES, SYSTEMS, AND METHODS FOR AUTOMATICALLY PRINTING AND APPLYING LABELS TO PRODUCTS

CROSS-REFERENCE TO RELATED APPLICATIONS

This U.S. non-provisional patent application claims the benefit of and priority to U.S. Provisional Application No. 62/066,268, filed Oct. 20, 2014, and relates to, claims priority to, and is a continuation-in-part application from U.S. patent application Ser. No. 14/043,259, filed Oct. 1, 2013, now U.S. Pat. No. 9,352,872, which claims the benefit of U.S. Provisional Application No. 61/709,403, filed Oct. 4, 2012, the disclosure of each of which is entirely incorporated by reference herein.

TECHNICAL FIELD

The subject matter presented herein relates to devices, systems, and methods for automatically printing and applying labels to products, such as shipping items, while the shipping items are moved along a conveyor.

BACKGROUND

Package labeling for warehouse and distribution application operations for products (e.g., packages, envelopes, and/or other types of 'shipping items') may require technique(s) for applying multiple shipping documents, such as labels. Labels may generally include shipping item identification, packing lists, return shipping labels, invoices, etc. Some current methods for providing a label for shipping items may include providing documentation inside shipping items or providing documentation in packing list pouches and/or envelopes, which are attached to the shipping items. Notably, utilizing packing list pouches or envelopes requires manually filing the pouches and/or envelopes with the documentation and then attaching the pouches and/or envelopes to the shipping items. Care must be taken to ensure that the labels and packing list pouches and/or envelopes do not interfere with each other. To date, there have been solutions to provide this information to outsides of shipping items. For example, one solution includes combining the labels with the packing lists by either printing the packing list information on opposite sides of the labels or utilizing a dual printing system. Alternatively, for example, labels may be printed and applied over the packing list labels with patterned adhesive. However, these conventional solutions do not meet most consumers' labeling needs.

Accordingly, a need exists for devices, systems, and methods for automatically printing and applying labels to products. In particular, a need exists for devices, systems, and related methods for automatically printing and applying dynamic sub-labels and cover labels capable of being stacked on top of one another and still being easily removable from one another.

SUMMARY

Devices, systems, and methods for automatically printing and applying one or more label to at least one item to enable shipping of the at least one item by a carrier. In some aspects, the device may comprise a movable label applicator device that includes a printer for printing the one or more label onto a supply of labeling material, wherein the one or more printed label contains unique information associated with the at least one item, and an applicator for applying the one or more printed label to a surface of the at least one item, wherein the applicator is configured to apply multiple labels to the surface of the at least one item such that the multiple labels are removably stacked on top of one another.

In some aspects, the system includes at least one controller comprising at least one hardware processor and a memory, the at least one controller being configured to: populate one or more label template with unique information associated with the at least one item, and queue an electronic representation of the one or more populated label template in print file format. The system may further include at least one movable label applicator device positioned above a conveyor transporting the at least one item and comprising a printer for printing the one or more label onto a supply of labeling material, wherein the one or more printed label contains the unique information associated with the at least one item, and an applicator for applying the one or more printed label to a surface of the at least one item, wherein the applicator is configured to apply multiple labels to the surface of the at least one item such that the multiple labels are removably stacked on top of one another.

In some aspects, the method may include populating one or more label template with unique information associated with the at least one item, queuing an electronic representation of the one or more populated label template in print file format, printing, by a printer of at least one movable label applicator device positioned above a conveyor transporting the at least one item, the one or more label onto a supply of labeling material, wherein the one or more printed label contains the unique information associated with the at least one item, and applying, by an applicator of the at least one movable label applicator device, the one or more printed label to a surface of the at least one item, wherein the applicator is configured to apply multiple labels to the surface of the at least one item such that the multiple labels are removably stacked on top of one another.

The subject matter described herein can be implemented in software in combination with hardware and/or firmware. For example, the subject matter described herein can be implemented in software executed by a processor. In one exemplary implementation, the subject matter described herein may be implemented using a computer readable medium having stored thereon computer executable instructions that when executed by the processor of a computer control the computer to perform steps. Exemplary computer readable media suitable for implementing the subject matter described herein include non-transitory devices, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

Advantages and features of the subject matter disclosed herein are set forth in part in the description which follows, and in part will become apparent to those skilled in the art upon examination of the following and the accompanying drawings or may be learned by production or operation of the examples. Advantages of the present teachings may be realized and attained by practice or use of the methodologies, instrumentalities and combinations described herein.

BRIEF DESCRIPTION OF THE DRAWINGS

The drawing figures depict one or more implementations in accordance with the present teachings, by way of example only, not by way of limitation. In the figures, like reference numerals refer to the same or similar elements.

DETAILED DESCRIPTION

Figure 1:
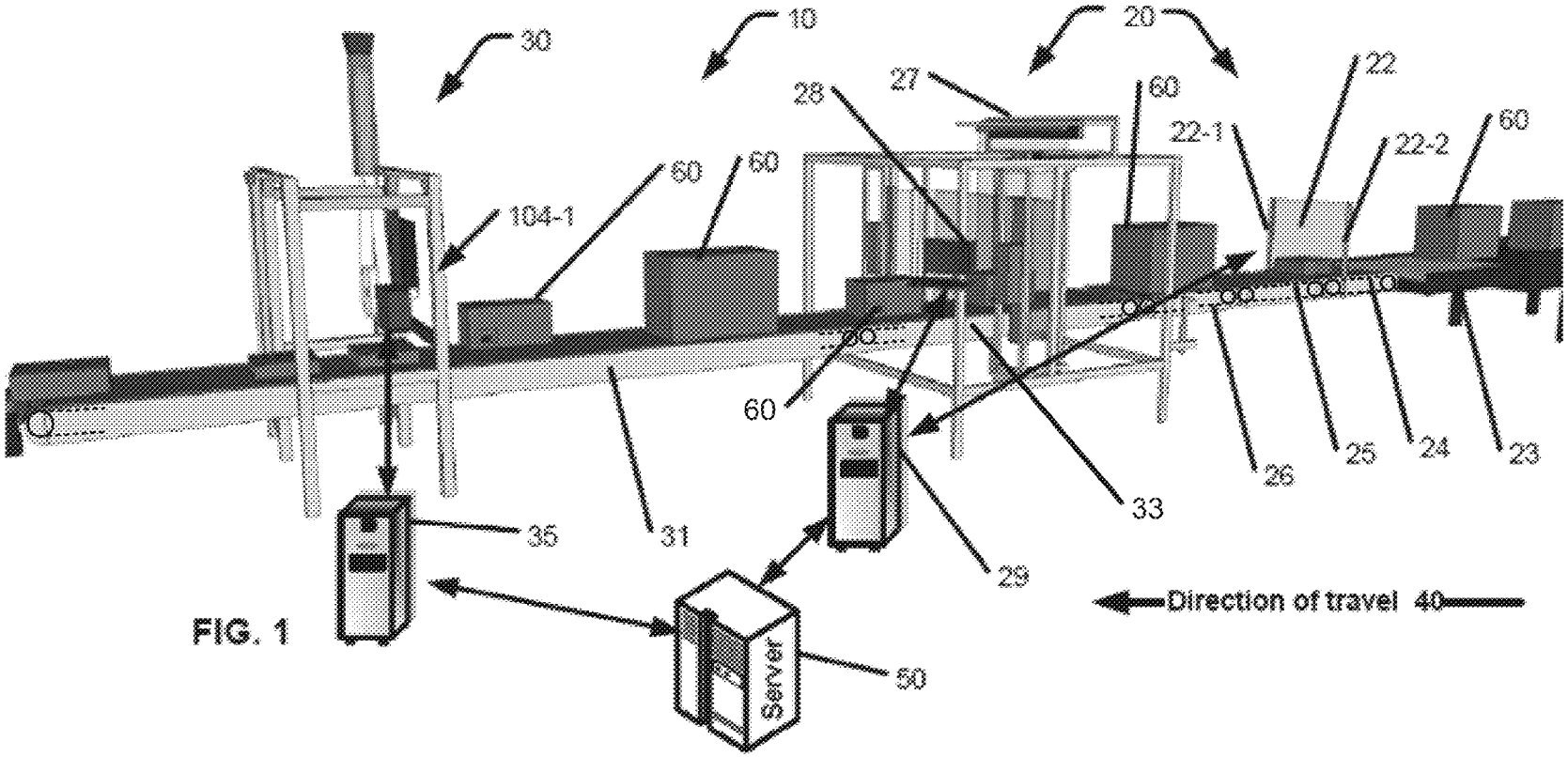
FIG. 1 is a front perspective view of an exemplary system for automatically printing and applying one or more label to at least one item, where the system includes a single movable label applicator, according to some aspects of the present subject matter.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The SIGNATURE 5000™ and SIGNATURE 3000™, manufactured by Bell and Howell, LLC, are movable printer and label applicator assemblies adapted to apply labels for packing list applications. The designs of the SIGNATURE 5000™ and/or SIGNATURE 3000™ allow for the basic labeling process of top-apply labeling for variable height shipping items that achieve a much higher throughput than traditional top-apply labeling systems. Higher throughput may be achieved, in one aspect, by dynamically locating a printer applicator relative to a labeling source. In this manner, when label application requires multiple labels to be applied to shipping items, efficiency of label application is increased substantially. In addition, the SIGNATURE 5000™ and/or SIGNATURE 3000™ may apply multiple labels on top of one another that can be individually removed and reapplied if required. Notably, if reapplying is desired for any label(s) within a label stack, it may be desirable that the label stack does not include the label in actual contact with the shipping item.

Linerless and linered labeler technology may be utilized for top-apply labeling on variable height shipping items, such that throughput rates may be dramatically increased due to elimination of labeling arm motion, which is required by traditional systems in order to retrieve a subsequent label following label application. In utilizing linerless technology, an interaction between silicon face stock coatings and adhesives may produce labels that will adhere well to shipping items, but are more easily removable from other labels. For example, a silicon top coat can be applied on a non-adhesive surface of the label material for easy removal of label material from, e.g., a roll of material or from other labels in a stack. Label lengths may vary during the print and apply process in order to provide various label length combinations to allow for easy removal or additional label coverage of sub-labels. This may provide an efficient and economical technique of producing and supplying labels. As defined herein, 'label' includes any type of label suitable for application to a surface of a package, envelope, box, etc. For example, labels may include packing lists, invoices, return labels, shipping labels, etc., which may be applied to a surface of an item or may be applied on top of an already applied label.

Accordingly, modifications to conventional automatic labeler systems, labels, and/or processing lines for a warehouse, consolidator, and/or distribution center may be required to make these systems capable of printing and applying labels to products such as shipping items. Shipping items may include any items to be processed by labeling systems disclosed herein. For example, the shipping items may be boxes of various sizes and shapes, provided they are consistent with conveyor and labeler systems. In addition, shipping items may include envelopes, polybags, sacks, and/or other odd shaped items that are packaged for shipping.

Reference now is made in detail to the examples illustrated in the accompanying drawings and discussed below. FIG. 1 illustrates a labeling processing line 10 for a warehouse, consolidator, and/or distribution center. There are numerous applications for the label processing line 10 which include, but are not limited to warehouse stocking, distribution center—retail or wholesale, order fulfillment, hub sorting operations for delivery services, etc.

In some aspects, processing line 10 may include a labeling assembly comprising a conveyor transport system 23, an image capture system, a controller 35, and a movable label applicator device 30 for labeling a product, e.g., an item 60, which may be a parcel, a package, a box, a flat envelope, a polybag, a sack, etc., of various sizes and shapes that is consistent with the conveyor and labeler systems. In some aspects, the shipping items 60 to be labeled enter the processing line 10 from the right on a conveyor system 23 and travel to the left, as indicated by the directional arrow 40. The directional arrow 40 is provided as a common frame of reference from figure to figure. However, the label application system 30 is designed to operate in a bi-directional manner with one or more label printer-applicator assemblies. For example, a single movable label applicator system 30 (see, FIG. 1) or double movable label applicator system 30 (see, FIG. 3A) can be used to, for example, apply stocking location labels on shipping items going to the warehouse and shipping labels to shipping items being routed from the warehouse to the shipping dock and eventually to the delivery service.

In some aspects, the data on the labels may include preprinted label or data referenced by a barcode, which may include, but is not limited to package contents, quantity, warehouse destination, retail or wholesale address, customer address, carrier (e.g., USPS®, UPS®, FEDEX®, DPD, GLS, PostCon, and DHL®), etc. Notably, the application for which the labels will be used may dictate the contents and format of the label(s) to be printed and applied by the label application subassembly (e.g., 100-1, FIG. 3A). A processor and/or computer 29, 35 and server 50 control and the data distribution configuration, as illustrated in FIG. 1, may be implemented in numerous ways depending on the desired design implemented.

In some aspects, the shipping items 60 are transferred from a shipping dock or warehouse through a shipping item measurement and label reader system 20 comprising a shipping item measurement subsystem 22. The shipping item measurement subsystem 22 may use a series of photo detectors distributed along sides 22-1, 22-2 to measure a height of the shipping items 60. A length of the shipping item 60 is measured by a length of time a height measurement is registering and a speed of conveyors 24 and 25. The height of shipping item 60 is used for accurate placement of the label on the top of the shipping item 60. Shipping item height is further used to position a movable label printer-applicator device and/or assembly 104-1 at a height that will allow for clearance above the next shipping item to be labeled. If weight is required for any of the sub-labels or cover label, a weight module may be included in the measurement subsystem 22. This height and length is processed by a shipping item measurement and label reader system computer 29 and transferred either through a server 50 or directly to a labeler control computer 35. For example, height and length data for each shipping item 60 is processed by the labeler computer 35 to determine a pitch between shipping items 60 that is needed for maximum throughput based on a vertical position of label printer-applicator device 104-1 within the system 30. In some aspects, one or more operator interfaces 28 may be provided for setup and job control.

A pitch-labeler control computer algorithm may be executed to determine the required shipping item pitch by projecting a required vertical position of the label printer-applicator device 104-1 within each label application subsystem 100-1, 100-2 (see, FIG. 3A), when the shipping item 60 that was just measured by the shipping item measurement subsystem 22, arrives at the label application subsystem 100-1. The required vertical height is dictated by the height of the shipping item 60 and a vertical distance that the label printer-applicator device 104-1 moves to apply a label or clear the next shipping item 60. A time of arrival of a given shipping item 60 at the system 30 is calculated by knowing a speed of conveyor 31 and a distance to be traveled. In reference to FIG. 3A, the arrival time of a given shipping item 60 at the label applicator subsystem 100-1 or 100-2 may be further adjusted by the conveyor stop time that is needed to apply multiple labels to the same shipping item 60. Sensors may be added along the conveyor path to update tracking accuracy and to confirm arrival of the shipping item 60 at the system 30, and arrival at a specific label printer-applicator device 104-1 assigned to apply the label. The shipping item pitch may be minimized and the vertical motion of the label printer-applicator device 104-1 may be minimized to achieve maximum throughput.

Referring back to FIG. 1, pitch between shipping items may be controlled by adjusting a speed of conveyors 24, 25 and 26 or by use of metering belts which stop and start in order to provide a correct gap. Additional methods for controlling pitch are also contemplated. Although three conveyors, i.e., 24, 25 and 26, are illustrated in FIG. 1, other configurations with more or less conveyors are also contemplated. After the shipping item height and length are measured, the shipping item 60 is transferred to image conveyor 33, which moves at a constant speed, and transports the shipping item through an image subsystem 27. The image subsystem 27 is configured to capture an image of the entire upward facing surface of the shipping item. The pitch between the shipping item 60 on image conveyor 33 and the closest shipping item 60 on the labeler conveyor 31 is monitored using encoder speed data and shipping item position as detected with photo sensors distributed along the conveyors. This pitch measurement is required because the labeler conveyor 31 must be stopped during the time required to apply the full stack of labels. The imaging conveyor 33 must continue to move while an image of the shipping item 60 is captured. The imaging conveyor speed 33 is continuously measured by an encoder and sent to the imaging subsystem 27 to adjust a scan rate of a camera to allow for some variation in the speed of the imaging conveyor 33. The speed variability of the image conveyor 33 can be used in the pitch control algorithm. Notably, however, the image conveyor 33 may not be stopped during image capture, and the pitch between the last shipping item 60 on the labeler conveyor 31 and the leading shipping item on the image conveyor 33 may not be allowed to become too small otherwise the label application subsystem 100-1 (see, FIG. 3A) will not operate correctly.

In some aspects, there are many design choices that are envisioned to achieve a correct pitch between shipping items 60 by measuring shipping item position on a system conveyor with photo detectors and measuring conveyor speeds with encoders. As disclosed herein, conveyors 24, 25, 26, 31 and 33 are each utilized for pitch control. Other configurations are also viable for achieving a shipping item pitch that maximizes throughput while ensuring that all subsystems can operate correctly.

Figure 2:
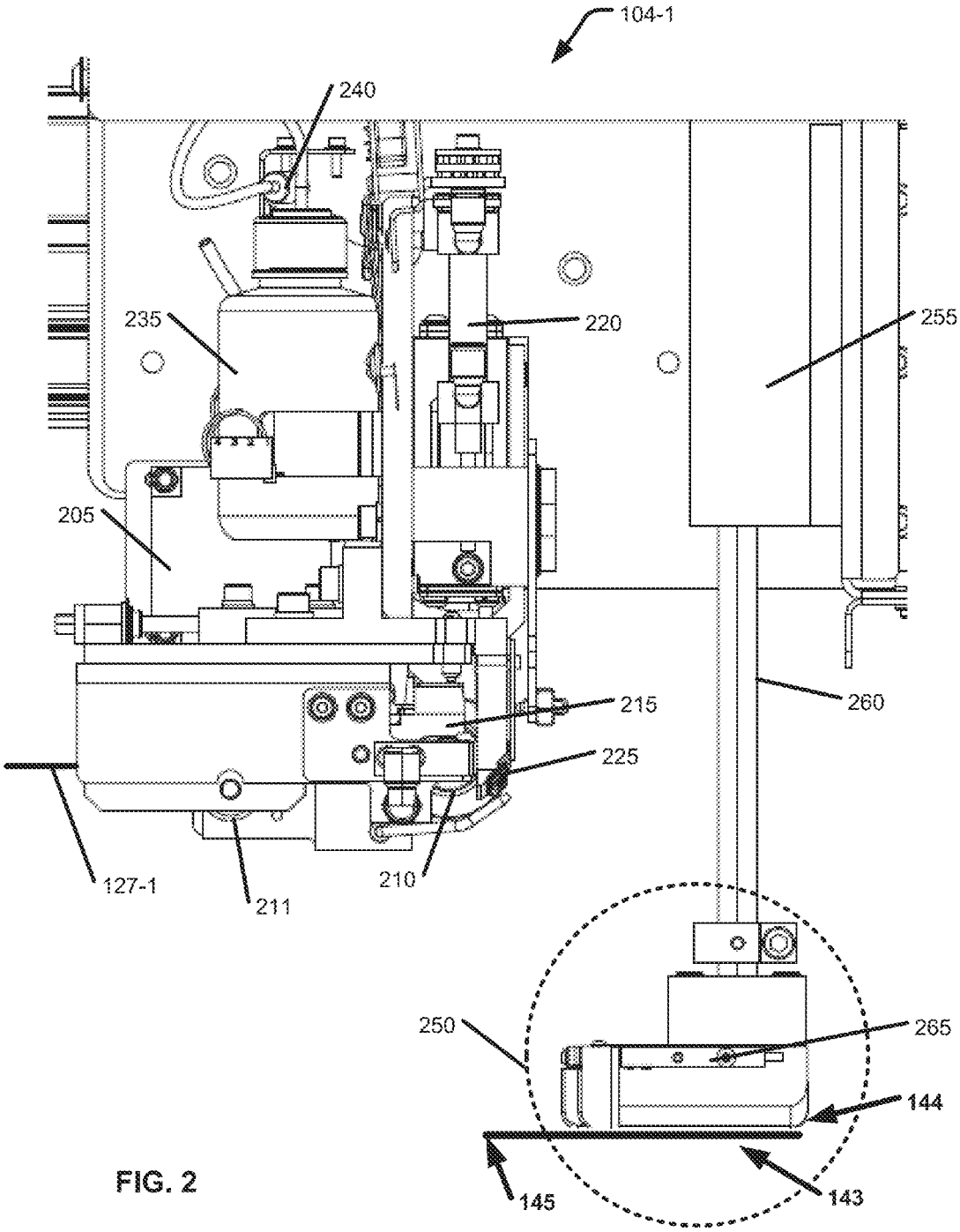
FIG. 2 is side view of an exemplary single movable label applicator device with an applicator in a down position according to some aspects of the present subject matter.

Referring now to FIG. 2, operation of a linerless label printer-applicator device 104-1 which is used to apply a cover label and one or more sub-label(s) 143 is illustrated in one embodiment. In some aspects, linerless label material does not have a backing material (e.g., a liner attached to the label material) which is required to prevent glue from sticking together layers in a roll 120-1 (see, FIG. 3A). Instead of a liner, the supply of labeling material 127-1 may comprise a top coating comprising a silicon release agent that is configured to provide for removal of labels individually from the stack of multiple labels. For example, a top surface of the label material may comprise a silicon release agent that allows for adhesive to release from the label material 127-1 in the roll 120-1. Other release agents may be utilized to achieve similar results. As an alternative, the label application system 30 may be configured to use a supply of linered label material.

In some aspects, an applicator 250, as illustrated in FIG. 2, is in a down position approximately six inches from a bottom of the pneumatic assembly 255. However, other distances may be used for the down position. The label material 127-1 enters the label printer-applicator device 104-1 from the left. The label material is pulled into the assembly 104-1 by a pressure roller 210, which is driven by motor 205. A plasma coated roller 211 is positioned in the input section to stabilize the web of label material 127-1. A plasma coating may be desirable in order to prevent adhesive from adhering to the label material 127-1 to the roller 211. As the label material 127-1 is pulled into the assembly 104-1, the thermal printer 215 prints the label contents and the label material advances through a label cutter assembly 225 and onto the applicator 250, which is in an up position against the bottom of the pneumatic assembly 255 (not shown). In some embodiments, the cutter 225 is configured to dynamically cut the one or more printed label into varying sizes depending on unique information and/or an amount of labels required for the at least one item. For example, where a unique shipping item identification number 141 disposed on a surface of at least one item indicates that three labels are required, the cutter 225 cuts the printed label material into three differently sized labels.

In some embodiments, the cutter 225 is actuated with a pneumatic cylinder 220. During the cutting operation, silicon oil may be applied to the blade by a pump 240. The oil reservoir is contained in a bottle/container 235. The silicon oil prevents adhesive buildup on the cutter blades, which will lead to cutter failure. The applicator 250 is driven by the pneumatic assembly 255 which controls the motion of the connecting piston 260. Proximity or height measurement sensors 265 signal the control box that the applicator 250 has nearly reached the shipping item and the pneumatic controls must adjust the speed and the remaining amount of stroke so that the label is applied firmly enough to stick by utilizing a forced air blast and to avoid the applicator from coming in contact with the shipping item.

Figure 3A:
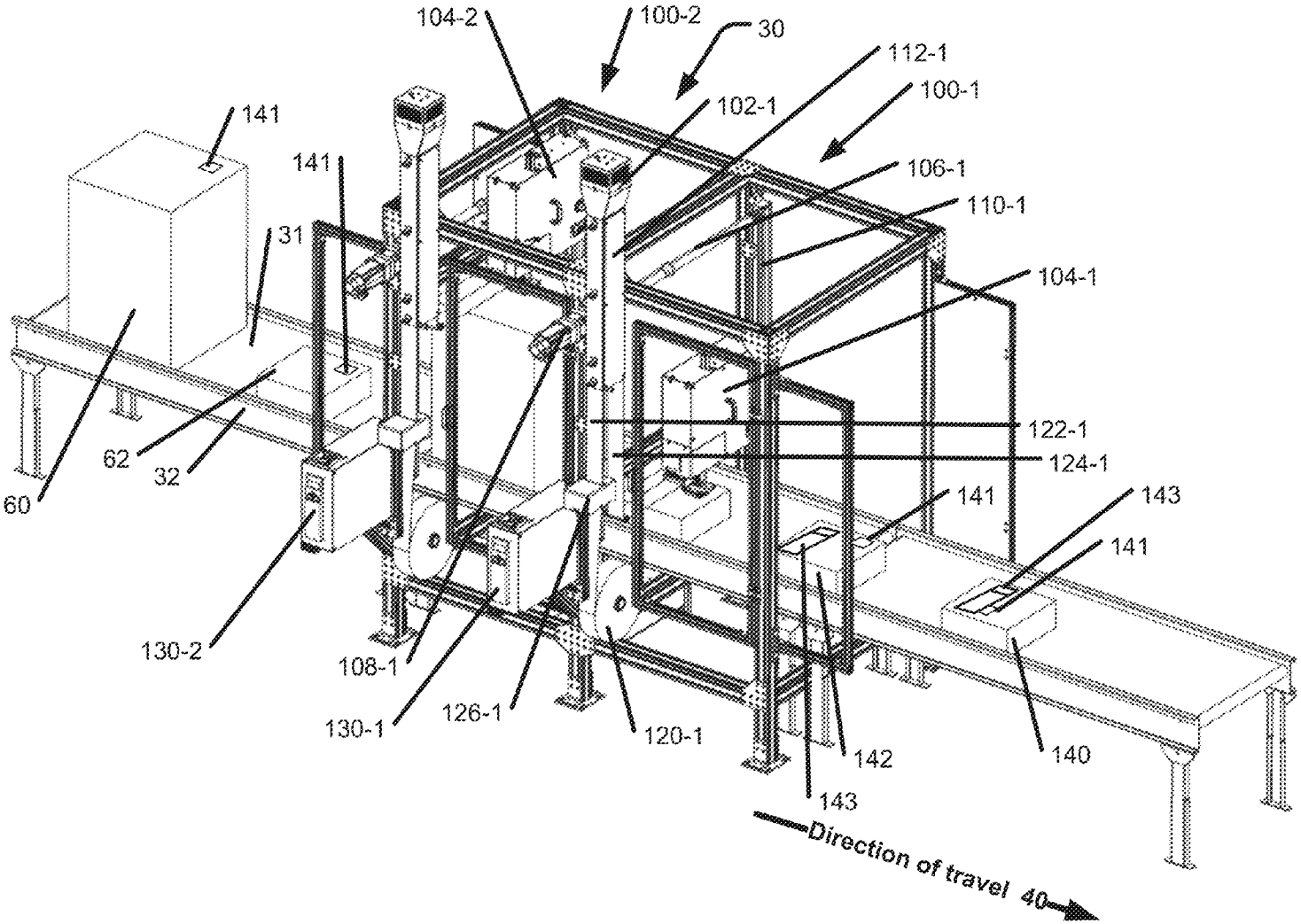
FIG. 3A is a front perspective view of an exemplary system for automatically printing and applying one or more label to at least one item, where the system includes a double movable label applicator device, according to some aspects of the present subject matter.

Referring now to FIG. 3A, an exemplary embodiment of a double or two label application system 30 is illustrated. In this exemplary embodiment, shipping items 60, 62 enter the double label application system 30 from a left side on conveyor 31 and travel through the double label application system 30 and exit on the right. Direction of travel arrow 40 illustrates the left to right processing. Shipping items 60, 62, and 142 are illustrated with a printed address label or shipping item identification label 141 attached thereto. In some aspects, a shipping item identification label 141 can be viewed through a window in an envelope mailpiece. The printed label may contain a delivery name and address, or shipping item identification (e.g., an alpha-numeric, a data matrix, and/or a barcode). A cover label and one or more sub-label(s) 143 may be applied by the label printer-applicator device 104-1. If all the shipping items 60, 62, 142 contain the same items, no identification label 141 is required, since the necessary data to complete the templates for the cover label and sub-labels can be retrieved from the system data stored in the system processors 29, 35 or received from a server 50, where the data may be contained in a database, flat file, and/or other data structure.

In the exemplary embodiment of a double or two label application system 30 illustrated in FIG. 3A, there is none or only a limited ability to move the label printer-cutter assembly 104-1 perpendicularly to the direction of travel 40. Therefore, the shipping items 60, 62, 142 on conveyor 31 are justified against a side rail 32 of the conveyor system. However, an alternative solution adds a servo controlled width positioning device and/or system that is configured to interface with the controller in order to dynamically repositioning the label printer-applicator assemblies 104-1, 104-2 right or left across the surface of the shipping item perpendicular to the direction of travel of the conveyor 31. In some aspects, dynamic repositioning is used when a clear zone is utilized to prevent application of one or more label over an existing feature(s) on the item or to ensure that an entirety of one or more label is applied to the item without any overhang.

The double label application system can comprise two identical label application subassemblies and/or devices 100-1 and 100-2. With regard to FIG. 3A, in order to avoid repetitive descriptions, like parts are labeled -1 for the first label application assembly 100-1 and -2 for the second label application assembly 100-2.

Each label application assembly is controlled by a control box 130-1, which includes operator controls on a top which are used for setup. The control box 130-1 can contain the servo and pneumatic controllers, as well as sensor inputs. Label print data, shipping item height data, and/or label placement information comes from a labeler control computer (see, 35, FIG. 1). The labeler control computer may also synchronize the operation of each of the double label application subsystems 100-1 and 100-2 to ensure that throughput is maximized and to ensure that the label printer-applicator device does not collide with a shipping item (e.g., 60, 62, 142, etc.). In reference to FIG. 3A, a labeler control computer may be mounted to the conveyor 31 frame and may be in communication with both control boxes 130-1 and 130-2.

In some aspects, linerless label material is pulled from a supply roll 120-1 by label material drive system 126-1. A speed at which the linerless label material 122-1 is pulled from the roll 120-1 is dependent on label usage, a position of the linerless label material 122-1 in a vacuum tower 112-1, and/or whether the label printer-applicator device 104-1 is being repositioned up or down or is stationary. Linerless label material 122-1 may be drawn into the vacuum tower 112-1 by a vacuum fan 102-1. The linerless label material 122-1 enters the vacuum tower 112-1, forms a loop in the vacuum tower, and exits on the other side with an adhesive side 124-1 of the linerless label material facing in. A vertical position of each label printer-applicator device 104-1 is controlled by the respective control box 130-1 using one or more servo motor 108-1. In some aspects, the servo motors 108-1 turn a drive shaft 106-1, which is connected to a toothed drive belt within the linear actuator 110-1, which in turn is connected to each label printer-applicator device 104-1. The drive shaft 106-1 then drives a linear actuator on each side of the label printer-applicator device 104-1

Figure 3B:
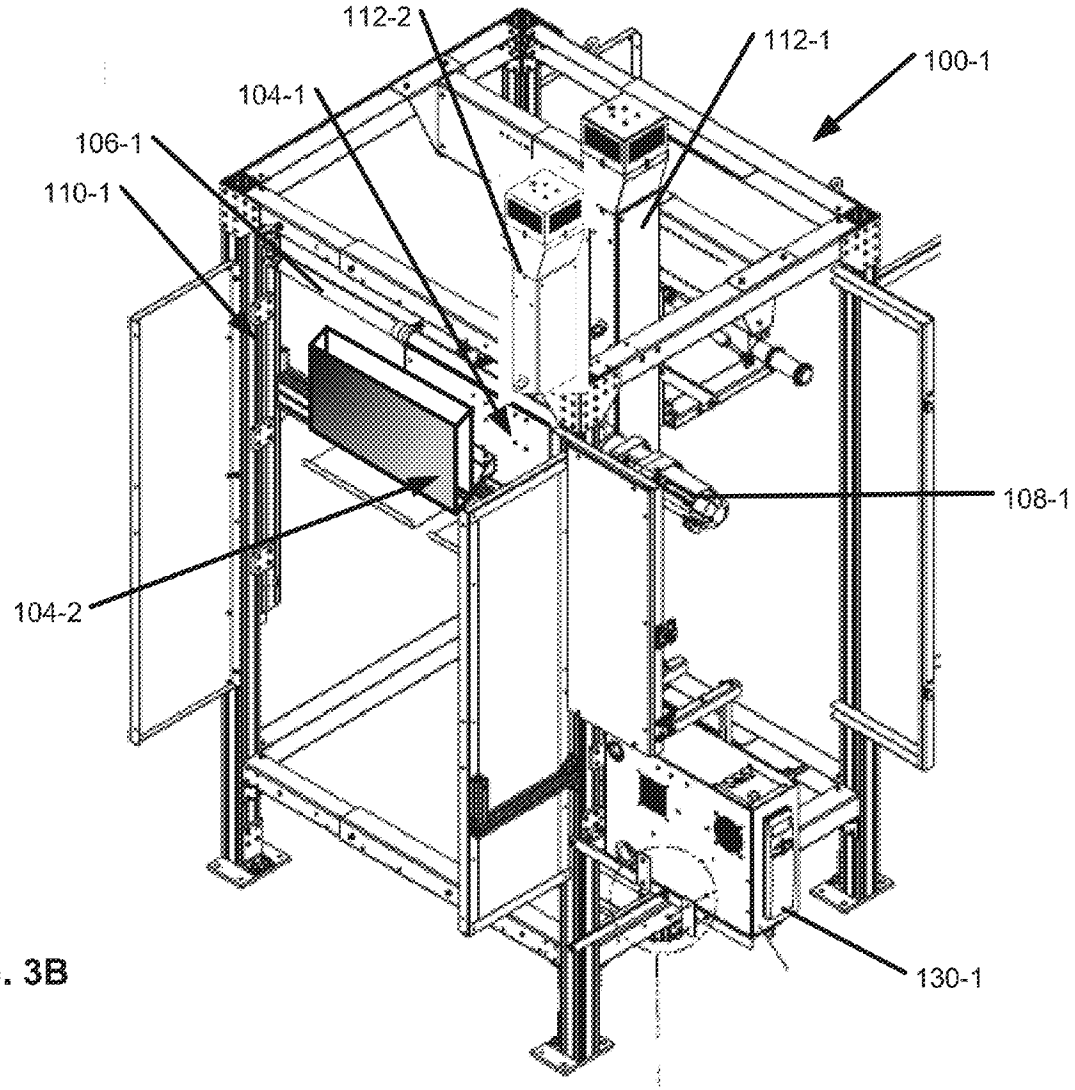
FIG. 3B is a front perspective view of an exemplary alternate double movable label applicator device according to some aspects of the present subject matter.

One exemplary alternate approach to the dual independent label application sub-assemblies 100-1 and 100-2, as illustrated in FIG. 3A, is to locate two label printer-applicator assemblies and/or devices 104-1, 104-2, as shown in FIG. 3B, on one gantry system of label application sub-assembly 100-1. The gantry system includes components such as the servo motor 108-1, the drive shaft 106-1, the linear actuator 110-1, and the control box 130-1. These components will support both label printer-applicator assemblies 104-1, 104-2; thus saving considerable expense. A label material distribution system, e.g., the vacuum towers 112-1 and 112-2, may be replicated so that each label printer—applicator assembly 104-1 and 104-2 can label independently with different linerless label material installed in each system, if so required. In addition, this makes it possible to have a different desired position (e.g., 146, FIG. 4A) for the sub-labels and the cover labels. Different width label material can be in the two label printer applicator assemblies 104-1 and 104-2 and different lengths can be commanded with the control system. In this manner, synchronization of the label printer-applicator assemblies needed to label the same shipping item 60 is made simpler since there is only one height adjustment. Additionally, positioning errors in the conveyor (see, 31, FIG. 3A) movement is small since the distance moved is small. These features can, thus, improve label stack quality when both label printer—applicator assemblies 104-1 and 104-2 are used to apply the stack of one or more labels.

In some aspects, both label printer-applicator assemblies 104-1, 104-2 can be used to apply labels to a single stack of labels or create multiple stacks thus creating greater throughput and label content. Since the conveyer 31 can be moved forward and backward, additional labeling outputs can be achieved. For example, the label printer-applicator assemblies 104-1 are used to print and apply one or more first labels (i.e., sub-labels) and then the label printer-applicator device 104-2 is used to print and apply one or more second labels (e.g., cover label). The second label may be similar to or different than the first label. For example, the one or more first label may be one or more cover labels and the second label may be a cover label that at least partially or entirely encapsulates the sub-labels to prevent damage during shipping. The process might be used with label printer-applicator device 104-2 to apply a blank label to the shipping item that is the same size as the cover label. The cover label may be easy to remove since it will not be adhering directly to the shipping item. In another example, conveyor 31 may be backed up so that label printer-applicator device 104-1 may be used to print and apply all sub-labels. Variable lengths are acceptable. The conveyor 31 may then be moved forward and label printer-applicator device 104-2 may apply the cover label. There is also the ability to apply two labels substantially simultaneously without stopping the shipping item (e.g., 60, FIG. 3A) and provided that the shipping item has sufficient width and length.

Figure 4A:
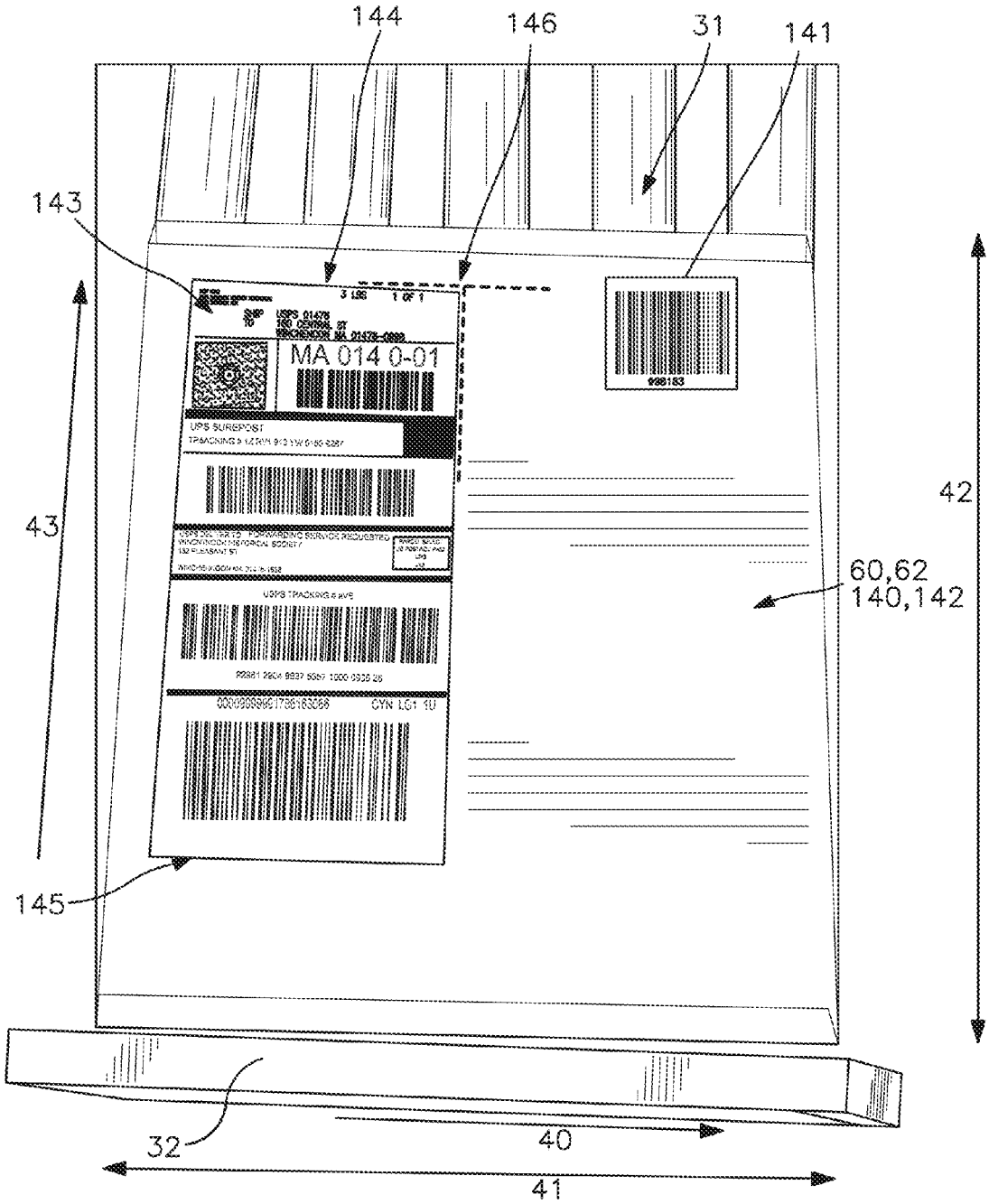
FIG. 4A is a line drawing of an exemplary item with a printed and applied label moving on a conveyor according to some aspects of the present subject matter.

Referring now to FIG. 4A, portions of exemplary products (e.g., shipping items 60, 62, 140, 142) and exemplary labels 141, 143 are illustrated. Notably, the terms identified in reference to FIG. 4A do not imply any restrictions or limitations in the design, configuration, and/or implementation of the disclosed subject matter. Changes based on customer requirements are contemplated.

In some aspects, a large variety of shipping items with numerous form factors can be processed by the label processing line 10 (see, FIG. 1). Since the products being labeled are, for example, either being pulled from a warehouse for delivery or being added to a warehouse for later distribution, these items are all referred to as shipping items 60, 62, 140, 142, although the items may not be items to be shipped. The contents of the shipping items 60, 62, 140, 142 are enclosed in boxes, envelopes, cartons, and/or custom shapes provided that there is a surface suitable for label application. As illustrated in FIG. 4A, when the shipping item 60 is placed on a conveyor system it is justified against a side rail 32. Automatic justification can be implemented, or the gantry holding the label applicator can be modified, for example, with a positioner that can move the assembly perpendicular to the direction of travel 40 of the conveyors. A width 42 of the shipping item 60 is a dimension perpendicular to the conveyor motion 40 and a length 41 of the shipping item 60 is in the direction of travel 40. As disclosed above, dynamically changing a label length will extend a cut edge 145 of the label in the width dimension 42. For example, a desired position 146 for a label 143 for the width 42 is fixed by a position of the applicator (e.g., 250, FIG. 2) from the side rail 32. A desired position 146, in the length 41 direction, is controlled by the product detect sensor at the entry point to a label application subsystem (e.g., 100-1. FIG. 3A) and the conveyor motion controller which moves the shipping item 60 a pre-determined number of encoder pulses before stopping the conveyor 31. This positioning results in a label leading edge 144 being applied at the desired position 146. In some aspects, for example, the label 143 may be applied at the desired position 146 via attachment to an applicator (e.g., 250, FIG. 2) with a vacuum. The label leading edge 144 is where the label printing started, which is not necessarily the top of the label 143. For example, label 143 printing can start at a bottom of the label data instead of at the top, as illustrated. The leading edge 144 may be farther away from a cutter of the movable label applicator device and the cut edge 145 may be closest to the cutter (e.g., 225, FIG. 2). Notably, in some aspects, the applicator is in an up position adjacent to a pneumatic assembly when the shipping label 143 is cut from a continuous web of linerless material.

Referring once again to FIG. 4A, the label 143 may be printed in direction 43 from top to bottom. The data content on the label 143 and the label length 41 may be controlled by a label template stored, for example, in a processor (e.g., one of the processors 29, 35, 50, FIG. 1). Template data may be accessed from a database that is referenced based on the information read from or decoded from a shipping item identification label 141. In the current example illustrated in FIG. 4A, the identification label 141 is located on the upward facing side of the shipping item and read or decoded by the imaging system (e.g., 27, FIG. 1) located above the shipping item. In some aspects, the identification label 141 may be located on the same face as or a different face from the shipping label 143 on the shipping item, where the imaging system can be configured to capture the data from the identification label 141 on any side of the shipping item.

Figure 4B:
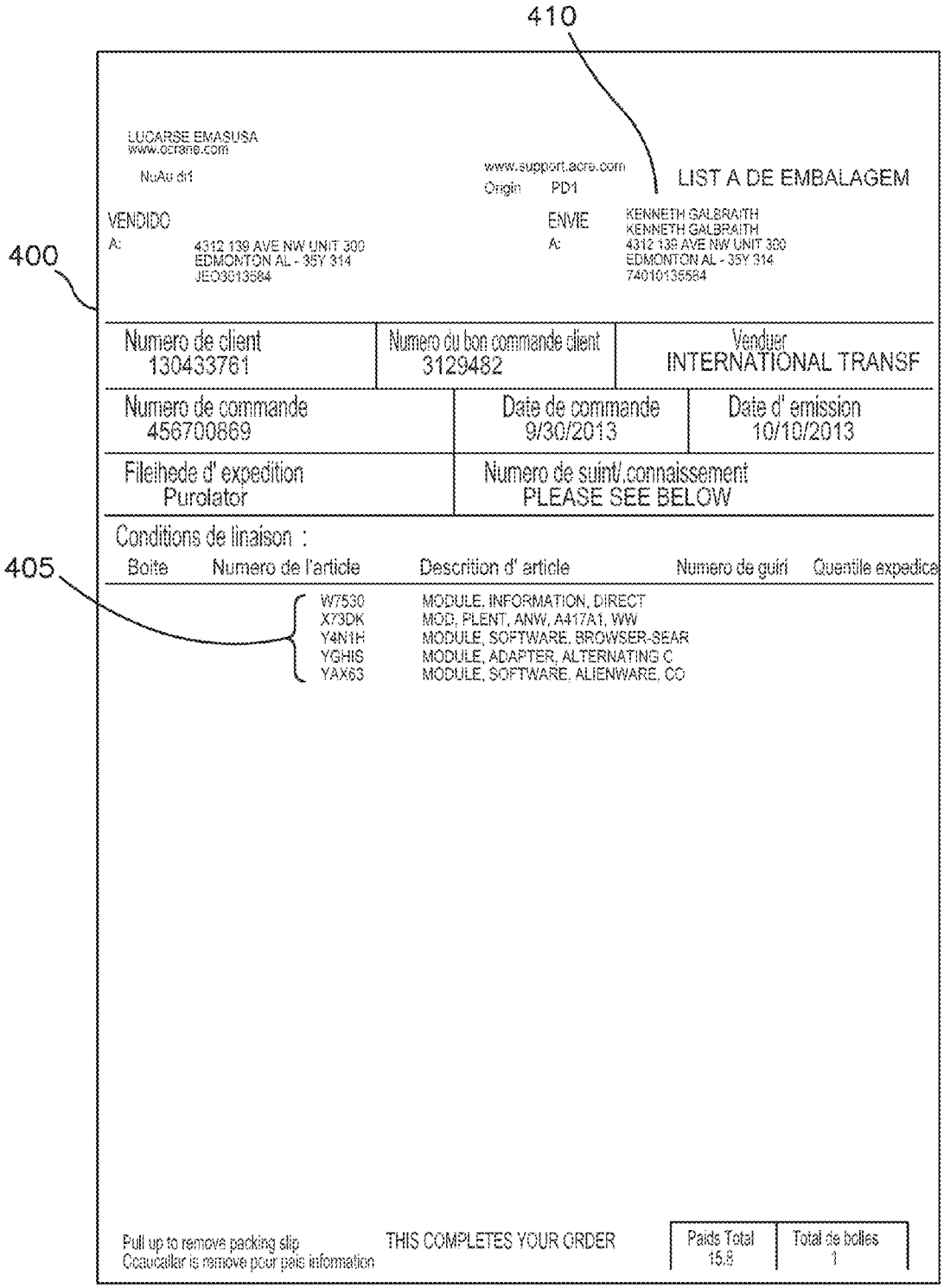
FIG. 4B is a line drawing of an exemplary packing list sub-label according to some aspects of the present subject matter.

Turning now to FIG. 4B, a line drawing of an exemplary packing list sub-label 400 that is applied to the shipping item 60 is illustrated. In some aspects, packing list sub-label 400 contains a list of items 405 in the shipping item (e.g., 60, FIG. 1) and the customer's data 410. Notably, the label content may be designed to meet the needs of the provider of the goods enclosed. In some aspects, the packing list sub-label 400 can be expanded to multiple labels that are applied in reverse order. Where the packing list sub-label 400 is a linerless label, the adhesive that is used on the linerless label is designed to have more adhesion to the envelope or shipping item than to the linerless label material. This provides an ability for a customer to easily peal each label from another label in order to view the contents of each label, such that the stack of labels stays affixed to the envelope or box.

Figure 4C:
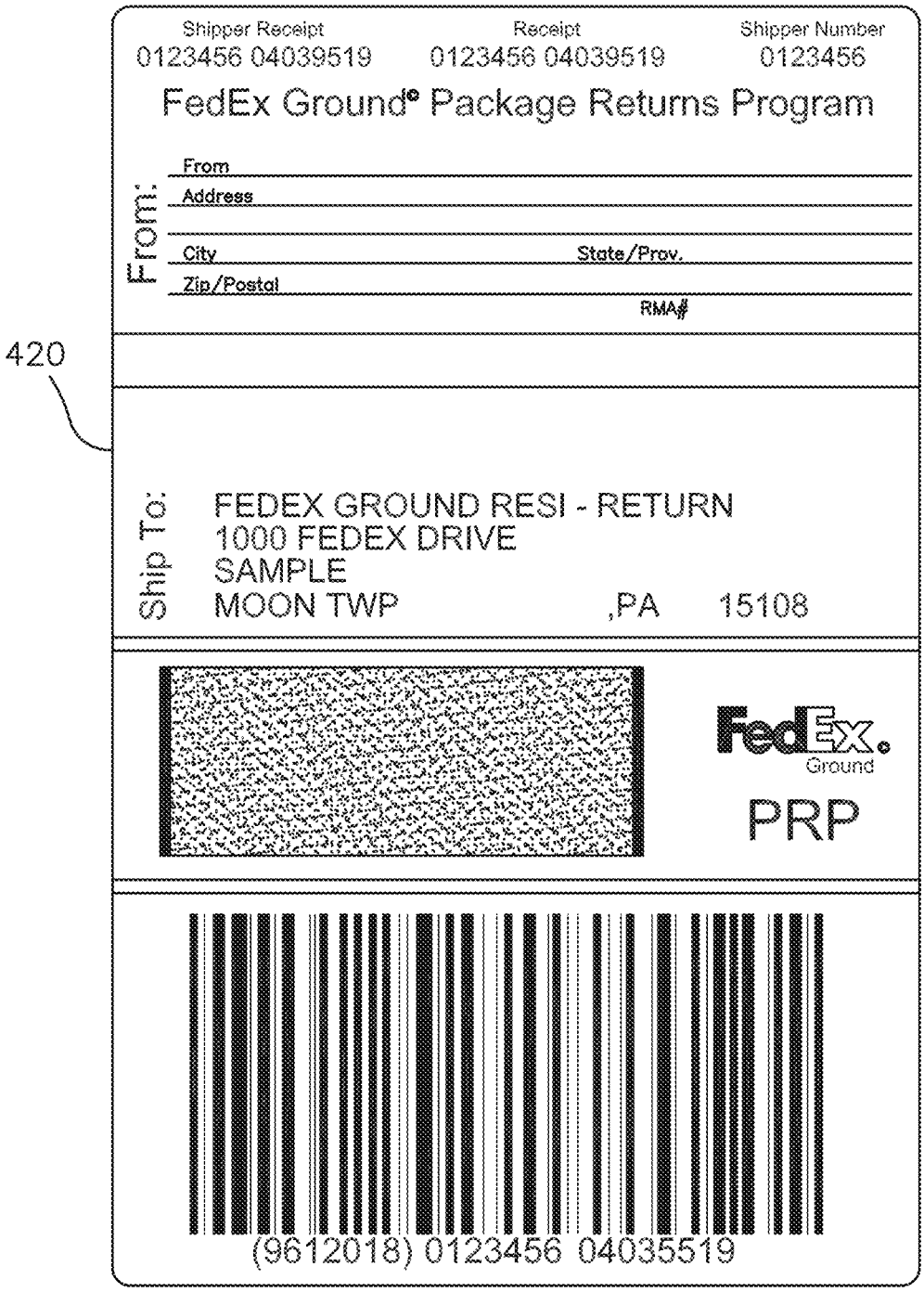
FIG. 4C is a line drawing of an exemplary return shipping sub-label according to some aspects of the present subject matter.

In some aspects, other sub-label types can be printed, such as, for example, a return shipping label. As illustrated in FIG. 4C, a line drawing of an exemplary return shipping label, generally designated 420, is provided. Once this label 420 is removed from the stack of sub-labels, it may be directly affixed to a return item (e.g., 60, FIG. 1) since the adhesive is already applied to the label. Alternately, in some aspects, the return shipping label 420 is applied directly to the shipping item, as a first sub-label, if the shipping item container is used for the return shipment. The return shipping label 420 may be, in some aspects, printed in color although it may also be desirable to be printed in black ink or gray scale. Numerous additional sub-labels can be utilized, such as, but not limited to, an invoice, a packing list 400 (see, FIG. 4B), a return shipping label 420, an invoice, an advertisement, a coupon, a blank label, etc.

Figure 5:
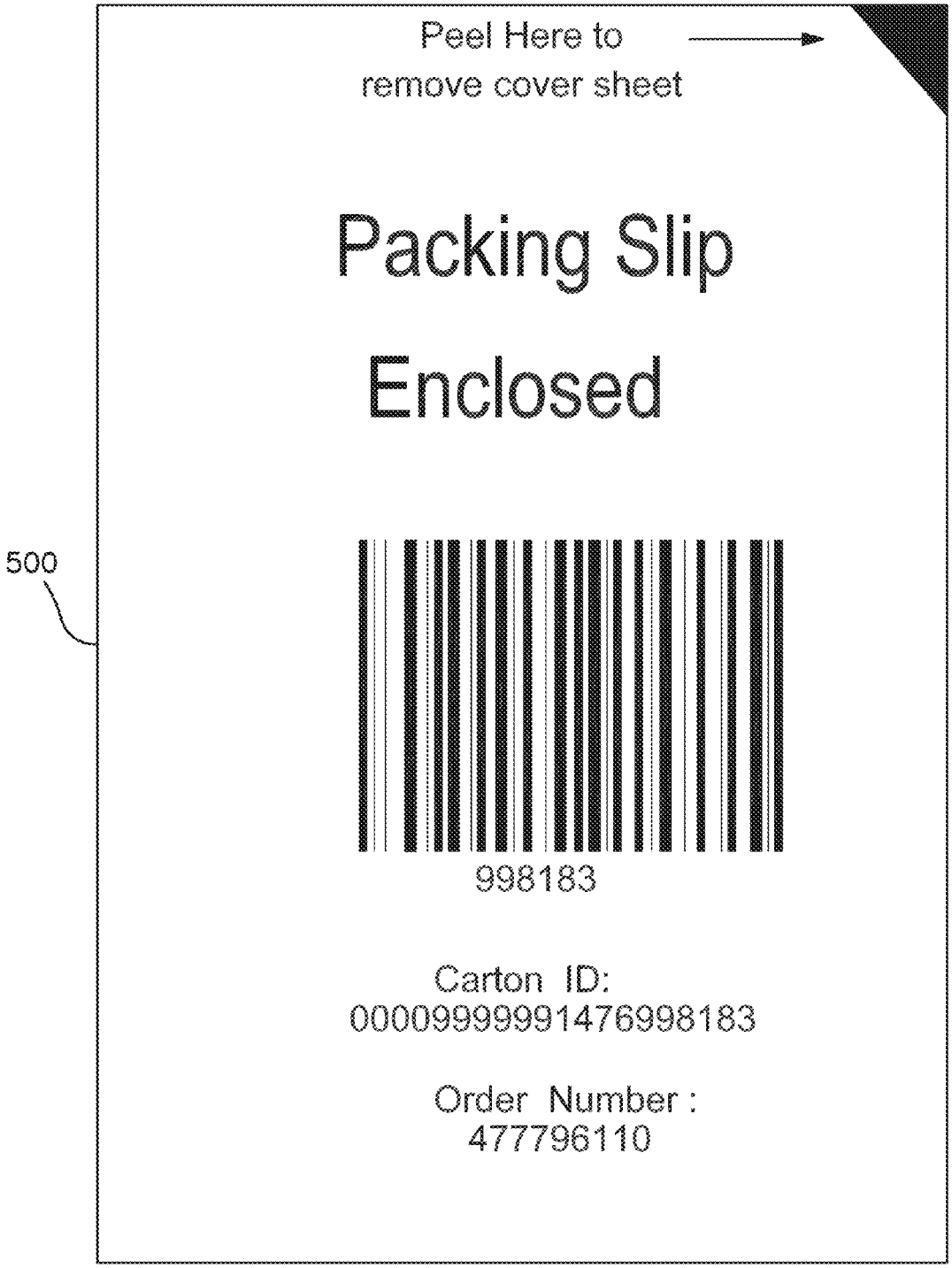
FIG. 5 is a line drawing of an exemplary carton identification (ID) top cover label according to some aspects of the present subject matter.

Once all the sub-labels have been printed and applied, a cover label may be applied to enable shipping by a delivery service such as but not limited to USPS®, UPS®, FEDEX®, DPD, GLS, PostCon, DHL®, etc. In some aspects, as illustrated in the line drawing of an exemplary carton identification (ID) label, generally designated 500, of FIG. 5, a carton ID label may be used to identify the shipping item (e.g., 60, FIG. 1), if additional processing is required before shipping or storage of the shipping item. The carton ID may enable easy and accurate retrieval of the shipping item from storage when the next processing step is ready.

Figure 6:
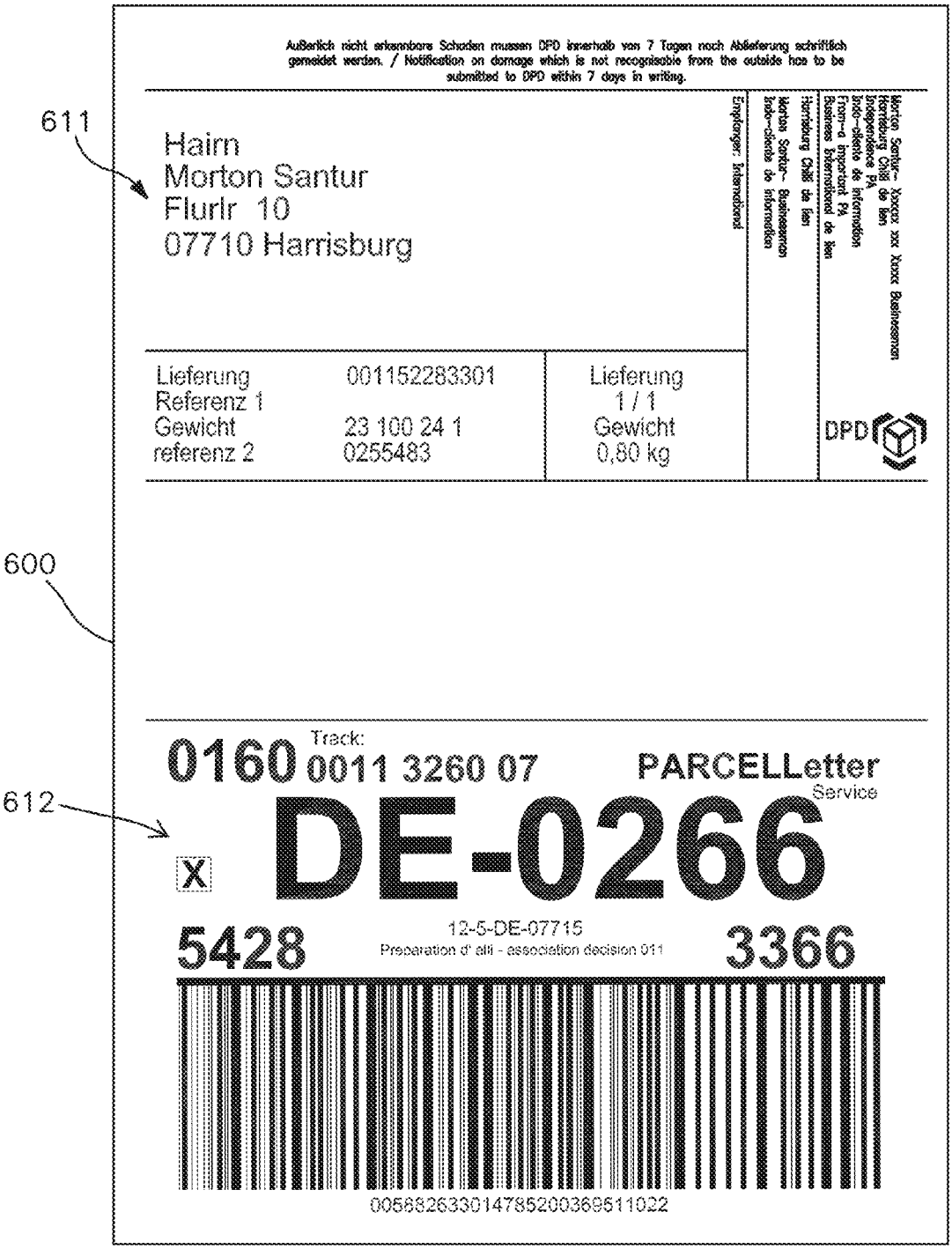
FIG. 6 is a line drawing of an exemplary shipping cover label according to some aspects of the present subject matter.

Referring now to FIG. 6, a line drawing of an exemplary international shipping label, generally designated 600, is provided. As illustrated in FIG. 6, international shipping label 600 may be a cover label, including one or more fields that may require population in a label template, such as, for example, a recipient name and address 611 and data required for shipment 612 by a carrier.

Figure 7:
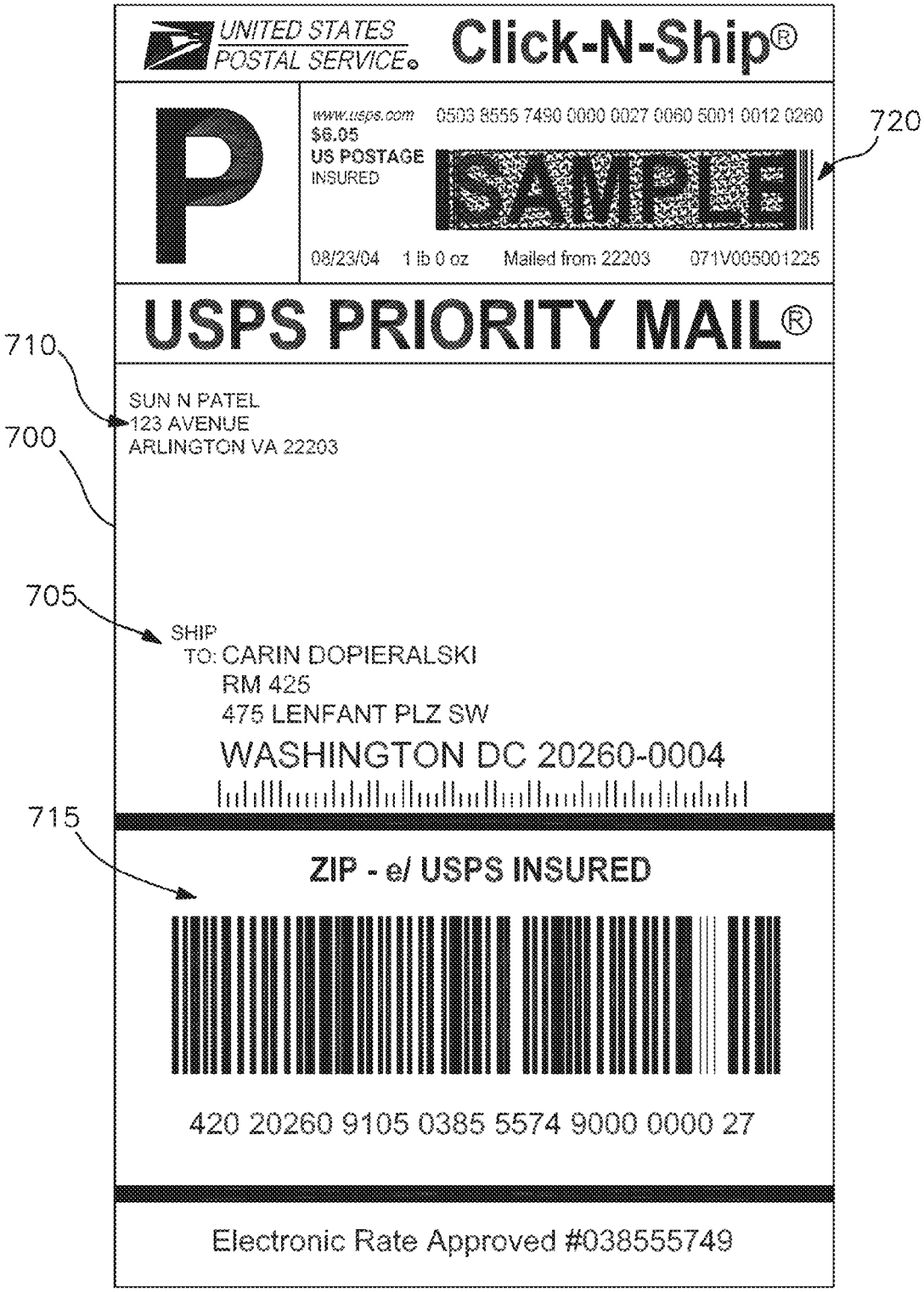
FIG. 7 is a line drawing of an exemplary long cover shipping label according to some aspects of the present subject matter.

Referring now to FIG. 7, a line drawing of an exemplary USPS® shipping label, generally designated 700, is provided. As illustrated in FIG. 7, the USPS® shipping label 700 includes a label format comprising a shipping address 705, a return address 710, a delivery barcode and tracking number 715, and postage 720. The label format of this label 700 may necessitate a longer label (in length and/or width) than other labels and/or sub-labels. In such a case, the label applicator 104-1 is designed to dynamically change label length depending on an amount of information to be printed.

In some aspects, variable label lengths are incorporated in the labels applied within the label stack to compliment the application needs. For example, labels may be cut, e.g., by the cutter 225, progressively shorter or longer as the stack is built by applicator 250. As a result, the applicator 250 can be configured to apply multiple labels of varying sizes (i.e., lengths) to form a stack of labels of varying sizes. One of the benefits of this type of configuration is to remove a label independently in the stack without disrupting the label below it. In order to accomplish this, the label length is shortened by a predetermined percentage to allow for easier removal of each label as compared to the label beneath. This length variance is prevalent in relation to a leading edge of the label (as viewed in a direction of movement of the label printing process). A trailing edge of alone or more labels in the stack are positioned consistently. For example, the trailing edges of all labels in the stack are positioned consistently. Alternatively, the trailing edges of all the labels are offset from one another, such that each label is applied offset from other labels in the stack. Another example of the use of variable length labels within the stack is to incorporate a longer top label to provide added adherence to the carton substrate. In addition, a blank label, of an appropriate size, may be applied to the shipping item prior to application of subsequent labels, such that the subsequent labels are removable without damage to the label beneath or to the item. In another example, a largest in size label is applied to the surface of the at least one item and additional labels are subsequently applied on top, where each subsequent label decreases in size relative to a previously applied label, starting with the largest in size label, to form a pyramid-like stack of labels.

The label can have postage 720 applied by integrating the label template population process with a certified postage product, such as but not limited to, STAMPS.COM®, the Data-Pac CURVE, etc. In some aspects, permit postage indicia can also be printed on the shipping label 700. The required weight data for postage calculation may be obtained from a measurement system (e.g., 22, FIG. 1) or may already be included in a shipping item database. In addition, in some aspects, any of the cover labels can be longer than the sub-label to provide extra protection to the sub-labels from damage during shipment or warehouse handling.

Figure 8:
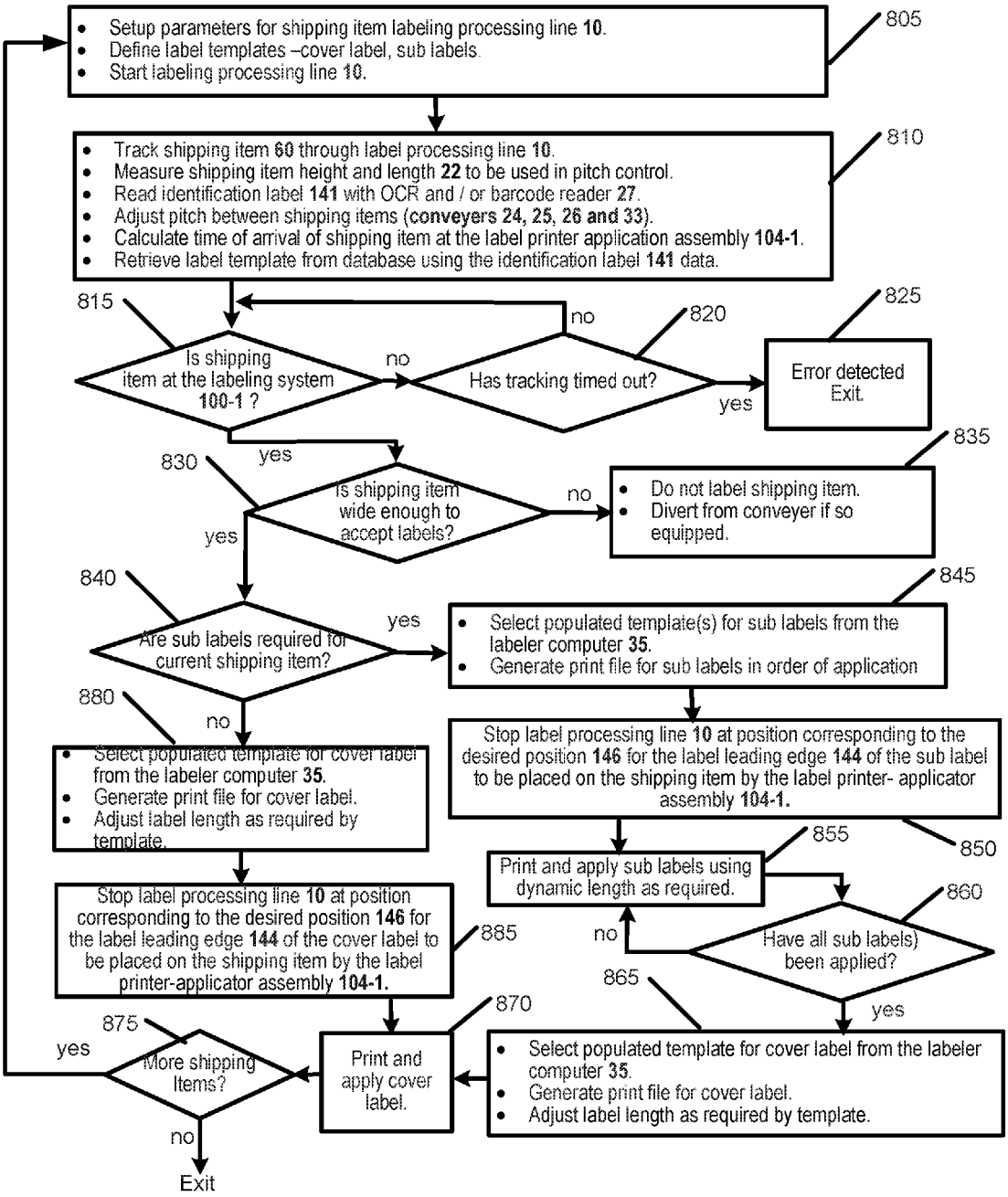
FIG. 8 is a process flow diagram of an exemplary process for automatically printing and applying one or more label to at least one item according to some aspects of the present subject matter.

Referring to FIG. 8, a flow diagram of an exemplary label applicator system process flow is illustrated. In step 805, various setup parameters and/or data associated with a job are loaded into system processors 29 and 35 from the server 50 (see, FIG. 1). For example, the system processors 29 and 35 may receive setup parameters comprising data and one or more label template associated with the at least one item being transported. The label templates may be those associated with unique shipping item identification numbers 141 to be processed. Other parameters associated with the labeling processing line 10 may be initialized, such as imaging system set up, conveyor speed constraints, and/or at least one label printer-applicator device 104-1, 104-2 (see, FIGS. 1, 3A, 3B) mounting position on a gantry to have the labels applied at a desired position 146. As such, the label templates contain unique information associated with the at least one item that is based on data read or decoded from the unique shipping item identification numbers 141 disposed on the surface of the at least one item. Once setup is complete, the labeling processing line 10 may be started and the operator may start loading the input conveyor 23. In step 810, automatic tracking of the shipping item 60 through the labeling processing line 10 is started. Height and length are measured in the shipping item measurement system 22. This data is used for pitch control and for shipping item clearance control by the label printer applicator assembly 104-1 in the label application sub-system 100-1. Pitch control is a continuously running algorithm that uses shipping item position and conveyor speed (including stop time) relative to other shipping items on the conveyors. Each of the conveyor segments (e.g., 24, 25, 26, 33, 31, FIG. 1) can be adjusted in speed as required to maintain pitch. The same parameters are used to determine the time of arrival of the shipping item at the input to the label application sub-assembly 100-1. Based on a sequence that data on identification label 141 is read, the shipping item label templates may be loaded and/or populated with data and queued up for the appropriate label printer applicator assembly 104-1. In some aspects, the queue comprises an electronic representation of the one or more populated label template in print file format. In such aspects, the electronic representation may correspond to the one or more printed label to be applied to the at least one item when a tracking system (e.g., a plurality of sensors disposed along the conveyor) indicates that the at least one item has arrived at the at least one movable label applicator device. In some aspects, the print queue matches the order and time of arrival of the shipping item. Steps 815 and 820 monitor a status of an item present photo sensor at an input to the label application sub-system 100-1 for the expected shipping item to arrive within a tolerance of the tracking system. In some aspects, an arrival time of the at least one item at the at least one movable label applicator device is controlled by a stop time of the conveyor, wherein the stop time of the conveyor is determined, at the at least one controller, based on a length of time required to print and apply the one or more label to the surface of the at least one item. If the shipping item 60 does not arrive within the tracking tolerance, an error has occurred, step 825, and the label processing line must be stopped. Notably, failure to take corrective action could result in incorrect labels being applied to the wrong shipping items for the rest of the job. In step 830, the shipping item width 42 is retrieved from data storage and/or manually determined and compared to a maximum length label that is to be applied to the shipping item. In step 835, if the label length exceeds shipping item width 42, then labeling cannot be performed. In particular, in step 835, the shipping item may be diverted automatically or extracted by an operator when the shipping item comes out of the label processing line 10, if the shipping item is not wide enough to accept labels.

In some aspects, the controller (e.g., computer 35) is configured to determine whether more than one label is required for the at least one item based on data read or decoded from a unique shipping item identification number (i.e., 141, FIG. 4A) disposed on the surface of the at least one item. For example and as illustrated in step 840, a determination if sub-labels in addition to the cover label, are required for a particular shipping item is performed. If yes, control is transferred to step 845, where sub-label templates, populated with the required data, are selected from the queued templates stored in the labeler computer 35. The print file for the sub-labels may be generated and queued for transmission to the label printer-applicator assembly 104-1 printer 215 (see, FIG. 2). In step 850, the label processing line 10 at conveyor 31 may be stopped so that the label leading edge 144 may be positioned at the desired position 146 when the sub-label is printed and applied by the label printer-applicator device 104-1. Conveyors 33, 26, 25, 24 may be stopped or slowed in accordance with the pitch control algorithm to maintain the required pitch. The sub-label is printed, cut to length 145, held on the applicator 250 with vacuum and pressed and/or tamped onto the shipping item in step 855. If all sub-labels in the queue have not been applied in step 860, the next sub-label is printed, cut to length 145, held on the applicator 250 with vacuum, and pressed and/or tamped onto the shipping item. When the last sub-label is applied in step 860, the data populated template for the cover label is selected from the labeler computer 35, in step 865. Next, the print file is generated for the cover label and the label length is set as required by the template. In step 870, the cover label is printed, cut to length 145, held on the applicator 250 with a vacuum, and pressed and/or tamped onto the shipping item. If there are more shipping items to be labeled, control is returned to step 805, and if not the job is exited, in step 875.

Conventional shipping item labelers move the applicator up to a home position to receive the next label to be applied. The home position, which may be, in some aspects, multiple feet above the shipping item, includes the printer, a label peeler and a liner take up reel. Movement of the applicator to the home position and back to the shipping item, for each sub-label or cover label may take significant time due to a distance traveled and a slow speed of a linear actuator. In contrast, the label printer-applicator 104-1 of the presently disclosed subject matter is moved into position, for example, less than six inches from a shipping item, before the shipping item is detected by the item present sensor. Each label is printed, held to the applicator 250 with vacuum and applied with a high speed pneumatic assembly 255 (see, FIG. 2). Throughput, in this manner, is higher than the above-described conventional approach due to a speed of the pneumatic actuator, six inch stroke versus the 36 inch stroke for the linear actuator used in the conventional approach.

In some aspects, if step 840 indicates that no sub-labels are required, the data populated template for the cover label is selected from the labeler computer 35, in step 880. Next, the print file is generated for the cover label and the label length is set as required by the template. In step 885, the label processing line 10 conveyor 31 is stopped so that the label leading edge 144 will be positioned at the desired position 146 when the cover label is printed and applied by the label printer-applicator device 104-1. Conveyors 33, 26, 25, 24 may be stopped or slowed in accordance with the pitch control algorithm to maintain the required pitch. Control is passed to step 870, where the cover label is printed, cut to length 145, held on the applicator 250 with vacuum, and pressed and/or tamped onto the shipping item. If there are more shipping items to be labeled, control is returned to step 805, and if not the job is exited, in step 875.

The label applicator sub-system process flow diagram depicted in FIG. 8 is exemplary in content and is not intended to limit the flexibility of a designer to reorder or modify the processing steps, provided the outcome meets the requirements of the label processing line 10.

As shown by the above discussion, functions relating pertain to the operation of a warehouse and distribution center shipping item labeling processing line wherein the labeling control is implemented in the hardware and controlled by one or more computers operating as, for example, control computers 29, 35 connected to the label application system 30, the shipping item measurement subsystem 22 and image subsystem 27 connected to a data center processor and/or server 50 for data communication with the processing resources are illustrated in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processors 29, 35 and/or the associated terminal device 28. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for controlling the warehouse and distribution center shipping item labeling processing line, in essentially the manner performed in the implementations discussed and illustrated herein.

Figure 9:
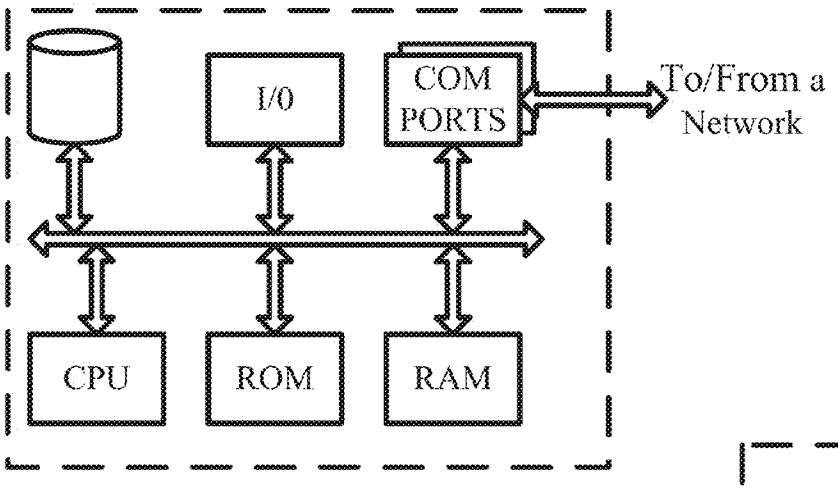
FIG. 9 is a box diagram of an exemplary network or host computer platform, as may typically be used to implement a server, according to some aspects of the present subject matter.
Figure 10:
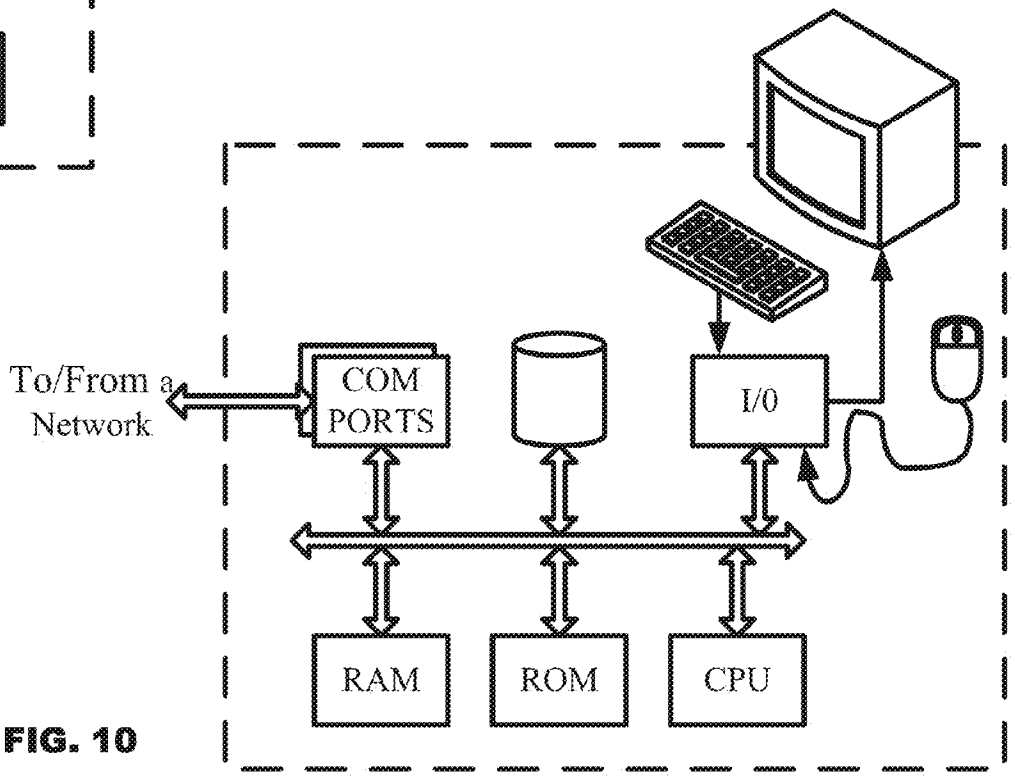
FIG. 10 is an exemplary computer with user interface elements, as may be used to implement a personal computer or other type of workstation or terminal device, according to some aspects of the present subject matter.

FIGS. 9 and 10 each illustrate functional block diagrams of general purpose computer hardware platforms. FIG. 9 illustrates a network or host computer platform, as may typically be used to implement a server. FIG. 9 depicts a computer with user interface elements, as may be used to implement a personal computer or other type of work station or terminal device, although the computer of FIG. 9 may also act as a server if appropriately programmed. It is believed that those skilled in the art are familiar with the structure, programming and general operation of such computer equipment and, as a result, the drawings should be self-explanatory.

For example, control processors 29, 35 may be a PC based implementation of a central control processing system like that of FIG. 9, or may be implemented on a platform configured as a central or host computer or server like that of FIG. 10. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model, i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the detailed description above, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

What is claimed is:

1. A movable label applicator device for automatically printing and applying a plurality of adhesive labels to at least one item to enable shipping of the at least one item by a carrier, the device comprising:

a printer for printing unique information associated with the at least one item onto one or more of the plurality of adhesive labels, wherein the one or more of the plurality of adhesive labels is generated from a supply of labeling material; and an applicator for applying the plurality of adhesive labels over a surface of the at least one item, wherein the applicator is configured to create a stack of adhesive labels from the plurality of adhesive labels, wherein the stack of adhesive labels is formed by applying a first of the plurality of adhesive labels to the surface of the at least one item and then removably applying others of the plurality of adhesive labels to a previously applied adhesive label in the stack of adhesive labels, so that the plurality of adhesive labels in the stack of adhesive labels are arranged on top of each other, and wherein each adhesive label in the stack of adhesive labels, other than the first of the plurality of adhesive labels, is adhesively applied to one or more adjacent labels in the stack of adhesive labels.

2. The device of claim 1, wherein the at least one item is selected from a group consisting of a parcel, a package, a box, a flat envelope, a polybag, and a sack.

3. The device of claim 1, wherein the unique information associated with the at least one item is based on data read or decoded from a unique shipping item identification number disposed on the surface of the at least one item.

4. The device of claim 1, further comprising a cutter configured to dynamically cut each of the plurality of adhesive labels into varying sizes depending on the unique information and/or an amount of labels required for the at least one item.

5. The device of claim 4, wherein the applicator is configured to:

apply multiple labels of varying sizes in the stack of adhesive labels, such that each label in the stack of adhesive labels is applied offset from the others of the plurality of adhesive labels, so that the stack of adhesive labels comprises adhesive labels of varying sizes, and/or apply, in forming the stack of adhesive layers, a largest in size label to the surface of the at least one item and subsequently apply the others of the plurality of adhesive labels so that that each subsequent label in the stack of adhesive labels is decreased in size or a same size relative to a previously applied label in the stack of adhesive labels, so the stack of adhesive labels comprises adhesive layers of varying sizes.

6. The device of claim 1, wherein the supply of labeling material comprises a top coating comprising a silicon release agent that is configured so one or more of the plurality of adhesive labels is individually removable from the one or more adjacent labels in the stack of adhesive labels over which the one or more of the plurality of adhesive labels is applied so that the one or more adjacent labels remain legible and/or undamaged during removal of the one or more of the plurality of adhesive labels.

7. The device of claim 1, wherein one or more of the plurality of labels are selected from a group consisting of: an invoice, a packing list, a return shipping label, an advertisement, a coupon, and a blank label.

8. The device of claim 1, wherein the applicator is configured to apply multiple labels of varying sizes in the stack of adhesive labels, such that a top cover label in the stack of adhesive labels is larger in at least one dimension than any other labels in the stack of adhesive labels, such that the top cover label is adhesively applied, at least partially, to the at least one item.

9. A system for automatically printing and applying a plurality of adhesive labels to at least one item to enable shipping of the at least one item by a carrier, the system comprising:

at least one controller comprising at least one hardware processor and a memory, wherein the at least one controller is configured to:

populate one or more label template with unique information associated with the at least one item, and queue an electronic representation of the one or more populated label template in print file format;

a conveyor configured to transport the at least one item; and at least one movable label applicator device positioned above the conveyor, the at least one movable label applicator comprising:

a printer for printing unique information associated with the at least one item onto one or more of the plurality of adhesive labels, wherein the one or more of the plurality of adhesive labels is generated from a supply of labeling material; and an applicator for applying the plurality of adhesive labels to a surface of the at least one item, wherein the applicator is configured to create a stack of adhesive labels from the plurality of adhesive labels, wherein the stack of adhesive labels is formed by applying a first of the plurality of adhesive labels to the surface of the at least one item and then removably applying others of the plurality of adhesive labels to a previously applied adhesive label in the stack of adhesive labels, so that the plurality of adhesive labels in the stack of adhesive labels are arranged on top of each other, and wherein each adhesive label in the stack of adhesive labels, other than the first of the plurality of adhesive labels, is adhesively applied to one or more adjacent labels in the stack of adhesive labels.

10. The system of claim 9, wherein the electronic representation of the one or more populated label template in print file format corresponds to one or more of the plurality of adhesive labels to be applied to the at least one item when a tracking system of the at least one controller indicates that the at least one item has arrived at the at least one movable label applicator device.

11. The system of claim 9, wherein an arrival time of the at least one item at the at least one movable label applicator device is controlled by a stop time of the conveyor, wherein the stop time of the conveyor is determined, at the at least one controller, based on a length of time required to print and apply the plurality of labels to the surface of the at least one item.

12. The system of claim 9, comprising a width positioning device configured to interface with the at least one controller to dynamically reposition the at least one movable label applicator device across the surface of the at least one item perpendicular to the direction of travel of the conveyor.

13. The system of claim 9, wherein the at least one movable label applicator device comprises a first movable label applicator device and a second movable label applicator device, wherein a first label of the plurality of labels is printed and applied to the surface of the at least one item by the first movable label applicator device and a second label, similar to or different than the first label, is subsequently printed and applied to the surface of the at least one item by the second movable label applicator device.

14. The system of claim 9, wherein one or more of the plurality of labels comprises permit postage indicia.

15. The system of claim 9, wherein the at least one controller is configured to determine a quantity of the plurality of labels required for the at least one item based on data read or decoded from a unique shipping item identification number disposed on the surface of the at least one item.

16. The system of claim 9, wherein the unique information associated with the at least one item is based on data read or decoded from a unique shipping item identification number disposed on the surface of the at least one item.

17. The system of claim 9, wherein the at least one movable label applicator device comprises a cutter configured to dynamically cut each of the plurality of adhesive labels into varying sizes depending on the unique information and/or an amount of labels required for the at least one item.

18. The system of claim 9, wherein the applicator is configured to:

apply multiple labels of varying sizes in the stack of adhesive labels, such that each label in the stack of adhesive labels is applied offset from the others of the plurality of adhesive labels, so that the stack of adhesive labels comprises adhesive labels of varying sizes, and/or apply, in forming the stack of adhesive layers, a largest in size label to the surface of the at least one item and subsequently apply the others of the plurality of adhesive labels so that that each subsequent label in the stack of adhesive labels is decreased in size or a same size relative to a previously applied label in the stack of adhesive labels, so the stack of adhesive labels comprises adhesive layers of varying sizes.

19. The system of claim 9, wherein the supply of labeling material comprises a top coating comprising a silicon release agent that is configured so one or more of the plurality of adhesive labels is individually removable from the one or more adjacent labels in the stack of adhesive labels over which the one or more of the plurality of adhesive labels is applied so that the one or more adjacent labels remain legible and/or undamaged during removal of the one or more of the plurality of adhesive labels.

20. The system of claim 9, wherein the applicator is configured to apply multiple labels of varying sizes in the stack of adhesive labels, such that a top cover label in the stack of adhesive labels is larger in at least one dimension than any other labels in the stack of adhesive labels, such that the top cover label is adhesively applied, at least partially, to the at least one item.

* * * * *